US008699937B2

(12) United States Patent
Yamaguchi et al.

(10) Patent No.: US 8,699,937 B2
(45) Date of Patent: Apr. 15, 2014

(54) IMAGE PROCESSING DEVICE

(75) Inventors: Takuya Yamaguchi, Toyokawa (JP); Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 13/075,604

(22) Filed: Mar. 30, 2011

(65) Prior Publication Data

US 2012/0051818 A1 Mar. 1, 2012

(30) Foreign Application Priority Data

Aug. 27, 2010 (JP) ..... 2010-190346

(51) Int. Cl.
*G03G 15/00* (2006.01)
*B65H 3/02* (2006.01)

(52) U.S. Cl.
USPC ..... 399/397; 271/291; 399/401

(58) Field of Classification Search
CPC ..... B65H 2513/41; B65H 3/0669; B65H 3/06
USPC ..... 271/4.01, 9.13, 10.01, 291; 399/397
See application file for complete search history.

(56) References Cited

U.S. PATENT DOCUMENTS

| | | | | |
|---|---|---|---|---|
| 6,260,840 | B1 * | 7/2001 | Suga et al. | 271/10.12 |
| 6,564,032 | B2 * | 5/2003 | Hara et al. | 399/328 |
| 6,595,512 | B2 * | 7/2003 | de Koning et al. | 271/125 |
| 7,467,790 | B2 * | 12/2008 | Westhoff | 271/3.14 |
| 2007/0140768 | A1 * | 6/2007 | Yoshida | 399/388 |
| 2008/0240824 | A1 | 10/2008 | Asada | |
| 2009/0087237 | A1 * | 4/2009 | Sato | 399/381 |
| 2009/0169280 | A1 * | 7/2009 | Tanahashi et al. | 399/397 |

FOREIGN PATENT DOCUMENTS

| | | | |
|---|---|---|---|
| CN | 1885209 | A | 12/2006 |
| JP | H09-100071 | A | 4/1997 |
| JP | 3087578 | B2 | 9/2000 |
| JP | 2002-332128 | A | 11/2002 |
| JP | 2005-263374 | A | 9/2005 |
| JP | 2008-044747 | A | 2/2008 |
| JP | 2008-247537 | A | 10/2008 |

* cited by examiner

*Primary Examiner* — Matthew G Marini
*Assistant Examiner* — John M Royston
(74) *Attorney, Agent, or Firm* — Baker Botts L.L.P.

(57) ABSTRACT

An image processing device, comprising a supplying path; a re-carrying path; and a supply and separation mechanism to carry and separate a sheet-like medium, and wherein the supply and separation mechanism comprises: a sending roller; an independent roller and a retard roller, and the sending roller includes an arc part and a recess formed inside of a trace of an outer circumferential surface of the arc part, the independent roller is able to rotate independently of the sending roller, the retard roller, by stopping or rotating in an inverse direction of a supplying direction, causes a frictional resistance with respect to the sheet-like medium being sent out by the arc part to separate the sheet-like medium one by one, and the image processing device further comprises: a control unit configured to cause the retard roller to rotate in the supplying direction when re-supplying is executed.

11 Claims, 9 Drawing Sheets

IMAGE PROCESSING DEVICE

CROSS-REFERENCE TO RELATED APPLICATION

This application claims priority under 35 U.S.C. §119 from Japanese Patent Application No. 2010-190346, filed on Aug. 27, 2010. The entire subject matter of the application is incorporated herein by reference.

BACKGROUND

1. Technical Field

Aspects of the present invention relate to an image processing device capable of executing both-side printing or both-side reading.

2. Related Art

Conventionally, image processing devices capable of executing both-side printing or both-side reading have been widely used. For example, an image forming device includes a paper supply roller for supplying a sheet of paper in a paper supply tray, an image formation unit, a paper carrying path connecting the paper supply tray with the image formation unit, and a re-carrying path for carrying again the sheet of paper which has been subjected to top-face printing to the paper carrying path for back-face printing. In the image forming device, the paper supply roller is backed, during the back-face printing, from a position at which the paper supply roller supplies the sheet of paper in the paper supply tray so as to prevent the paper supply roller from hampering the paper carrying during the back-face printing.

SUMMARY

However, regarding the above described configuration of the image forming device, when the paper supply roller is backed during the back-face printing, the sheet of paper carried from the re-carrying path to the paper carrying path cannot be carried by the paper supply roller. In this case, a sheet of paper having the length smaller than or equal to a predetermined length can not be used. In order to use the sheet of paper having the length smaller than or equal to the predetermined length, it is necessary to employ an additional carrying roller serving to carry the sheet of paper in place of the paper supply roller. As a result, the size of the image forming device increases.

Aspects of the present invention are advantageous in that they provide an image processing device capable of carrying a sheet-like medium having a relatively small length from a re-carrying path to a carrying path when the sheet-like medium ejected from an image formation unit is returned again to the carrying path via the re-carrying path so that the sheet of paper is supplied again to the image formation unit.

According to an aspect of the invention, there is provided an image processing device, comprising: a supplying path along which a sheet-like medium is carried from a sheet accommodation unit to an image processing unit; a re-carrying path along which the sheet-like medium ejected from the image processing unit is returned to the supplying path; and a supply and separation mechanism which is provided on the supplying path and is configured to carry and separate the sheet-like medium one by one. The supply and separation mechanism comprises: a sending roller which rotates in a supplying direction to supply the sheet-like medium, the sending roller including an arc part which sends out the sheet-like medium by contacting the sheet-like medium and rotating, and a recess which is formed inside of a trace of an outer circumferential surface of the arc part defined when the arc part rotates; an independent roller provided coaxially with the sending roller and having an radius smaller than or equal to a radius of the arc part and larger than a minimum radius of the recess, the independent roller being able to rotate independently of the sending roller; and a retard roller which is provided to contact the independent roller and the arc part of the sending roller, and is configured such that, by stopping or rotating in an inverse direction of the supplying direction, the retard roller causes a frictional resistance with respect to the sheet-like medium being sent out by the arc part of the sending roller so as to separate the sheet-like medium one by one. In this configuration, the re-carrying path merges with the supplying path through a nipping part between the independent roller and the retard roller. The image processing device further comprises: a control unit configured to cause the retard roller to rotate in the supplying direction when re-supplying for supplying again the sheet-like medium which has passed the re-carrying path toward the image processing unit is executed.

BRIEF DESCRIPTION OF THE ACCOMPANYING DRAWINGS

DETAILED DESCRIPTION

Hereafter, an embodiment according to the invention will be described with reference to the accompanying drawings. In the following, first a general configuration of a color printer which is an example of an image forming device is explained, and thereafter the feature of the color printer is explained in detail.

Figure 1:
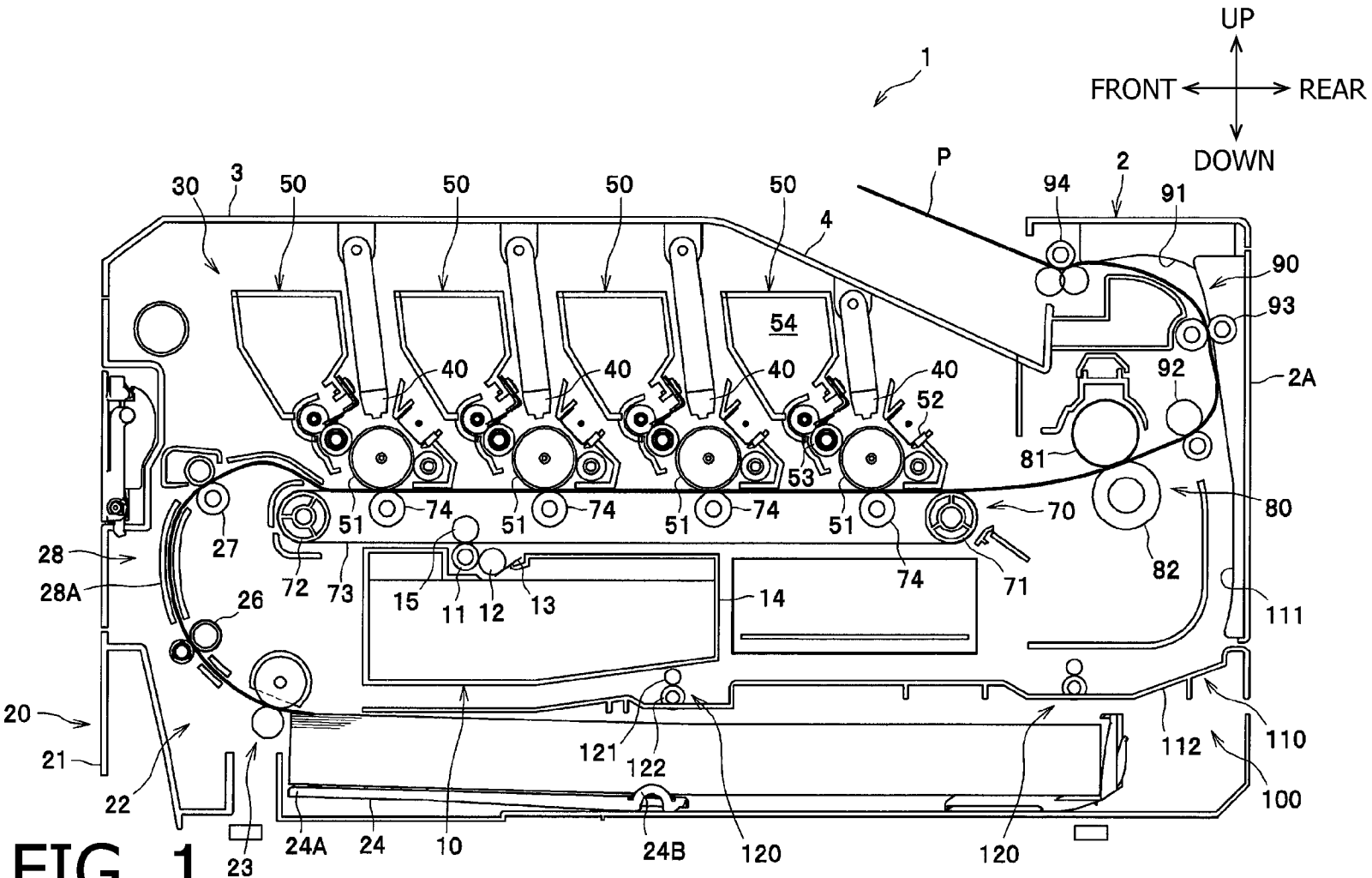
FIG. 1 is illustrates a color printer according to an embodiment.

In the following explanation, directions are defined with respect to a user's position defined when the user uses the color printer. That is, the left side on FIG. 1 is defined as a "front side", the right side on FIG. 1 is defined as a "rear side", a far side on FIG. 1 is defined as a "left side", and a near side on FIG. 1 is defined as a "right side". An up and down direction on FIG. 1 is defined as a vertical direction.

First Embodiment

As shown in FIG. 1, a color printer 1 according to the embodiment includes, in a main body 2, a paper supply unit 20 which supplies a sheet of paper P, an image formation unit 30 which prints an image on the supplied sheet of paper P (an example of a sheet-like medium), and a paper ejection unit 90 which ejects the sheet of paper P on which an image has been printed.

The paper supply unit 20 includes a paper supply tray 21 (a paper accommodation unit) and a paper supply mechanism 22 which carries the sheet of paper P from the paper supply tray 21 to the image formation unit 30. The paper supply tray 21 is arranged, at the lower part of the main body 2, to be detachably attachable with respect to the main body 2. The paper supply tray 21 accommodates a stack of sheets of paper P, and includes a pressure plate 24 which pushes upward the sheets of paper P.

The paper supply mechanism 22 is arranged on the front side of the paper supply tray 21. The paper supply tray 22 includes a supply and separation mechanism 23, and a plurality of pairs of carrying rollers 26 and 27. The supply and separation mechanism 23 is provided in a central part of the sheet of paper P in the width direction of the sheet of paper P. The supply and separation mechanism 23 will be explained in detail later.

The supply and separation mechanism 23 and the rollers 26 and 27 are arranged along a paper carrying path 28 formed to connect the paper supply tray 21 and the image formation unit 30. The paper carrying path 28 is formed to have a shape of a letter "U" with a pair of arc-like guides 28A.

In the paper supply unit 20 configured as described above, the sheets of paper P are separated one by one and sent out by the supply and separation mechanism 23, and is carried by the carrying rollers 26 and 27 while being pinched by the rollers 26 and the rollers 27. Then, the sheet of paper P is turned to the rear side while proceeding along the paper carrying path 28, and is supplied to the image formation unit 30.

The image formation unit 30 is located on the upper side of the paper supply tray 21, and includes four exposure units 40, four process cartridges 50, a transfer unit 70, a belt cleaner 10, and a fixing unit 80.

Various types of known exposing manners, such as laser exposing and LED exposing, can be employed in the exposure unit 40. In this embodiment, LED arrays are employed respectively for the process cartridges 50. Each LED array is supported by an upper cover 3.

The process cartridges 50 are arranged in the front and rear direction between the upper cover 3 and the paper supply unit 20. Each process cartridge 50 includes a photosensitive drum 51 on which an electrostatic latent image is formed, a charger 52, a development roller 53 and a toner chamber 54 in which a toner (an example of a developer) stored. The four process cartridges 50 store black toner, yellow toner, magenta toner and cyan toner, respectively.

The transfer unit 70 is arranged between the paper supply unit 20 and the process cartridges 50, and includes a drive roller 71, a driven roller 72, a carrying belt 73 and four transfer rollers 74.

The drive roller 71 and the driven roller 72 are arranged to be away from each other in the front and rear direction and to be in parallel with the front and rear direction. The carrying belt 73 (an endless belt) is hooked to the drive roller 71 and the driven roller 72 to be stretched between the drive roller 71 and the driven roller 72. The four transfer rollers 74 are arranged inside the carrying belt 73 such that the transfer rollers 74 face the photosensitive drums 51, respectively, to pinch the sheet of paper P between the transfer rollers 74 and the photosensitive drums 51. Each transfer roller is applied a transfer bias through constant current control during the transferring.

The belt cleaner 10 is arranged under the carrying belt 73. The belt cleaner 10 contacts the carrying belt 73 to collect substances, such as toner and dust, adhered to the carrying belt 73. Specifically, the belt cleaner 10 includes a contacting roller 11, a collecting roller 12, a blade 13 and a discharged toner chamber 14.

The contacting roller 11 is arranged to contact an outer circumferential surface of the carrying belt 73. By applying a collecting bias between the contacting roller 11 and a backup roller 15 located to contact the inner surface of the carrying belt 73, the contacting roller 11 collects the adhered substances on the carrying belt 73.

The collecting roller 12 contacts the contacting roller 11, and collects the adhered substances on the contacting roller 11. The adhered substances on the collecting roller 12 are scraped off by the blade 13 arranged to contact the collecting roller 12, and enter into the discharged tone chamber 14.

The fixing unit 80 is arranged on the rear side of the process cartridges 50 and the transfer unit 70. The fixing unit 80 includes a heat roller 81, and a pressure roller 82 which is located to face the heat roller 81 to press the heat roller 81.

In the image formation unit 30 configured as described above, surfaces of the photosensitive drums 51 are charged uniformly and positively by the respective chargers 52, and then are exposed with the respective exposure units 40 based on image data. As a result, the potential of an exposed portion on each photosensitive drum 51 decreases, so that an electrostatic latent image is formed on each photosensitive drum 51. Thereafter, by supplying the toner from the development roller 53 to the electrostatic latent image, a toner image is formed on each photosensitive drum 51.

The sheet of paper P supplied on the carrying belt 73 is carried between each photosensitive drum 51 and each transfer roller 74 located inside the carrying belt 73. Consequently, the toner image formed on each photosensitive drum 51 is transferred to the sheet of paper P. Then, the sheet of paper P is carried between the heat roller 81 and the pressure roller 82. As a result, the toner image transferred on the sheet of paper P is heat-fixed.

The paper ejection unit 90 includes an ejection side carrying path 91 which is elongated upward from an exit of the fixing unit 80 and is turned toward the front side, and ejection rollers 92, 93 and 94. The sheet of paper P on which the toner image is heat-fixed is carried along the ejection side carrying path 91 by the ejection rollers 92, 93 and 94, and is ejected to a paper output tray 4.

The ejection rollers 93 and 94 of the paper ejection unit 90 constitutes a part of a re-carrying mechanism 100 configured to inversely move the sheet of paper P on which an image has been printed by the image formation unit 30 and to return the sheet of paper P to the upstream side of the image formation unit 30. The re-carrying mechanism 100 is explained in detail later.

The re-carrying mechanism 100 operates as follows. In a both-side printing mode, the sheet of paper P whose top face has been subjected to the image formation is ejected to a midway point between the ejection roller 94 and the paper output tray 4, and thereafter is moved inversely by inverse rotation of the ejection roller 94. Then, the sheet of paper P is carried again to the paper supply mechanism 23 through the space between the image formation unit 30 (the belt cleaner 10) and the paper supply tray 21. Then, the sheet of paper P proceeds along the paper carrying path 28, so that the sheet of paper P is supplied again to the upstream portion of the image formation unit 30 in a state where the sheet of paper P is reversed. As a result, an image is formed on a back face of the sheet of paper P by the image formation unit 30, and then the sheet of paper P which has been subjected to the both-side printing is ejected to the paper output tray 4.

Figure 2:
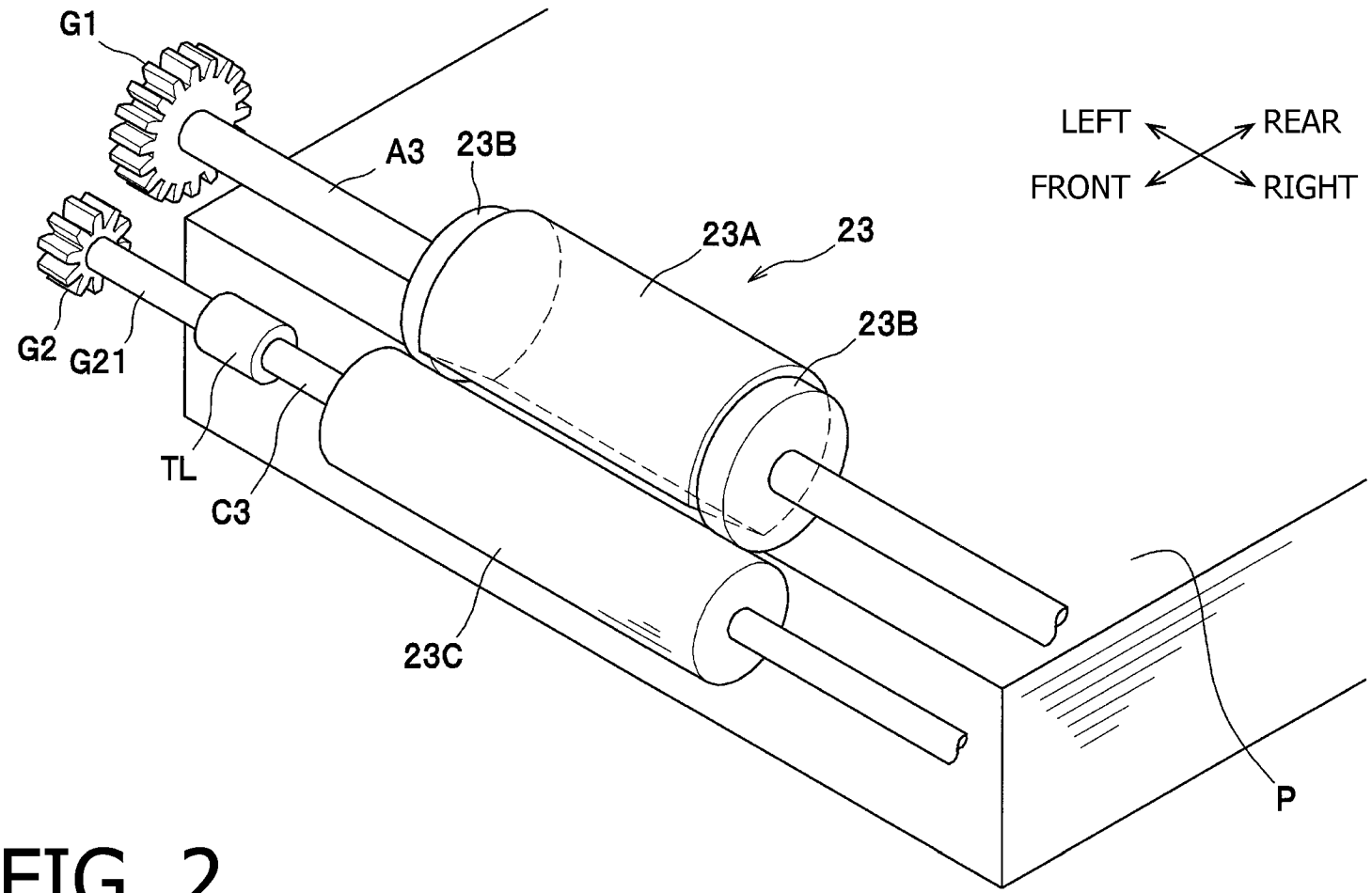
FIG. 2 is a perspective view of a supply and separation mechanism and a paper supply tray shown in FIG. 1.

Configurations of the supply and separation mechanism 23 and the re-carrying mechanism 100 will now be explained. As shown in FIGS. 2 and 4, the supply and separation mechanism 23 includes a sending roller 23A, an independent roller 23B, and a retard roller 23C.

The sending roller 23A includes an arc part A1 which sends out the sheet of paper P by contacting the sheet of paper P and rotating, and a recess A2 which is formed inside a trace of an outer circumferential surface of the arc A1 defined when the arc A1 rotates. The sending roller 23A is integrally provided with the rotation shaft 23A at a rotation center of the sending roller 23A. At a left end of the rotation shaft A3, a sending gear G1 is fixed to be coaxially with the rotation shaft A3.

The sending roller 23A and the paper supply tray 21 (i.e., the pressure plate 24) are arranged such that the arc part A1 contacts the sheet of paper P accommodated in the paper supply tray 21 by rotation of the sending roller 23A.

The pressure plate 24 is arranged such that a front end part 24A is able to swing up and down with respect to a rear end part 24B (see FIG. 1) by a driving mechanism having a motor and a gear (not shown) or by a spring so as to lift up the leading edge part of the sheets of paper P. It should be noted that, upward movement of the pressure plate 24 is restricted at a predetermined height so that the position of the leading edge part of the sheet of paper P placed on the top of the stack of sheets of paper is kept at a constant height.

Figure 4A:
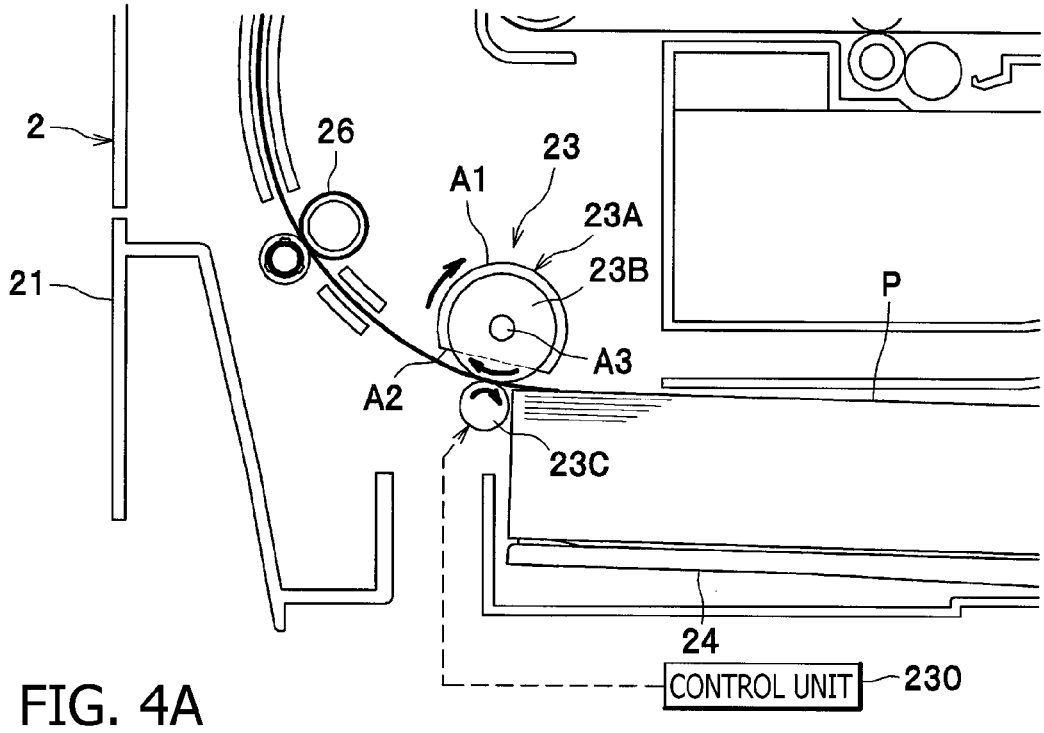
FIG. 4A is a vertical cross section illustrating the supply and separation mechanism during top-face printing.

When a driving force is transmitted to the sending gear G1, as shown in FIG. 4A the sending roller 23A carries, through the arc part A1, the sheet of paper P in the paper supply tray 21 to the carrying roller 26 by rotating in a supplying direction (the clockwise direction in FIG. 4A in regard to the sending roller 23A).

The independent roller 23B is a roller which has a radius smaller than or equal to a radius of the arc part A1 of the sending roller 23A and is larger than a minimum radius of the recess A2. The independent roller 23B is provided coaxially with the sending roller 23A, and is able to rotate independently of the sending roller 23A. Specifically, the independent rollers 23A are provided respectively at both ends of the sending roller 23A in the axial direction of the sending roller 23A, and are able to rotate with respect to the rotation shaft A3 of the sending roller 23A. That is, since the independent roller 23B is able to rotate with respect to the rotation shaft A3, the independent roller 23B rotates in accordance with rotation of the retard roller 23C when the sheet of paper P does not exist between the independent roller 23B and the retard roller 23C. On the other hand, the independent roller 23B rotates in accordance with the movement of the sheet of paper P when the sheet of paper P exists between the independent roller 23B and the retard roller 23C.

The independent roller 23B is made of resin which is relatively rigid in comparison with the sending roller 23A made of rubber having an elasticity and having a high degree of friction with respect to a sheet of paper. The resin of the independent roller 23B has a property that the toner is hard to adhere thereto in comparison with the material (i.e., rubber) of the sending roller 23A.

Figure 3:
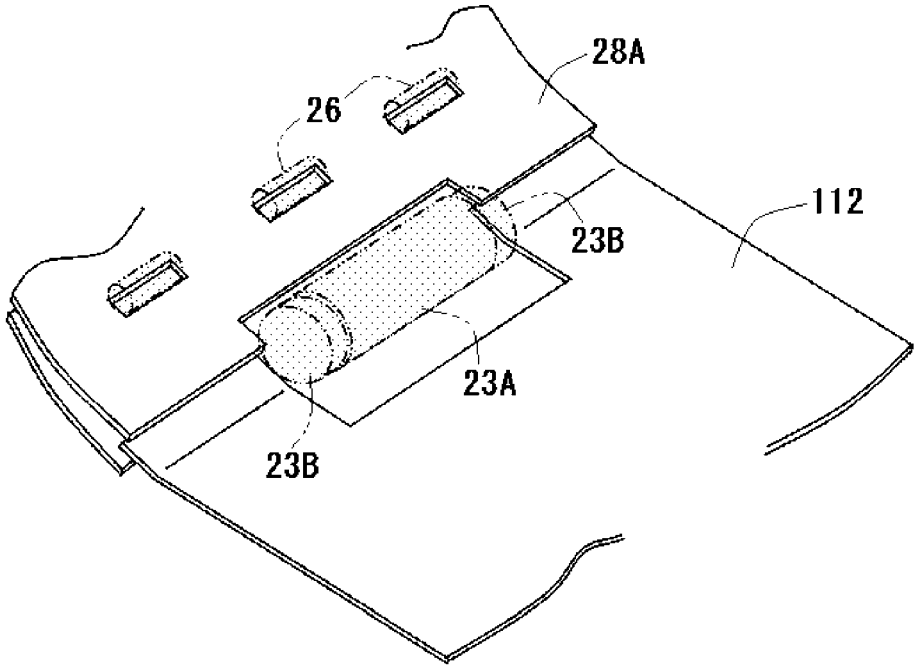
FIG. 3 is a perspective view illustrating a positional relationship between a carrying guide for a re-carrying path and a guide of a carrying path shown in FIG. 1.

The retard roller 23C is a roller made of rubber having a high degree of friction. By rotating in a reverse direction (clockwise direction in FIGS. 3A and 3B) of the supplying direction (counterclockwise direction for the retard roller 23C), the retard roller 23C is able to produce a frictional resistance for the sheet of paper P being sent out by the arc part A1 of the sending roller 23A so that the sheet of paper is separated one by one. In this embodiment, the control unit 230 controls the retard roller 23C so as to rotate counterclockwise direction during the back-face printing so that the retard roller 23C is able to carry the sheet of paper P.

Specifically, the retard roller 23C is formed to have the length in the axis direction substantially equal to the combined length of the sending roller 23A and the independent rollers 23B in the axis direction or is formed to protrude outward in the axial direction with respect to the independent rollers 23B provided at both ends of the sending roller 23A. The retard roller 23C is arranged such that the outer circumferential surface of the retard roller 23C contacts the arc part A1 of the sending roller 23A and the independent rollers 23B. At the rotation center of the retard roller 23C, the retard roller 23C is integrally connected to the rotation shaft C3 rotatably supported by the main body. The rotation shaft A3 and the rotation shaft C3 are arranged to be able to move close to or away from each other at least by a distance corresponding to the difference between the arc part A1 of the sending roller 23A and the independent roller 23B. The rotation shaft A3 and the rotation shaft C3 are pressed such that the retard roller 23C and the arc part A1 of the sending roller 23A or the independent roller 23B are able to contact with each other. It should be noted that, when the above described difference between the arc part A1 of the sending roller 23A and the independent roller 23B is small and the retard roller 23C is able to contact the arc part A1 of the sending roller 23A or the independent rollers 23B, the rotation shaft A3 and the rotation shaft C3 need not be provided to be able to close to or away from each other. At the left end of the rotation shaft C3, a rotation shaft G21 of a retard gear G2 is connected via a torque limiter TL. With this configuration, a driving force from a motor M (see FIG. 5) is transmitted to the retard roller 23C via the torque limiter TL.

When the retard roller 23C is rotated in the clockwise direction (an inverse direction of the supplying direction), the torque limiter TL transmits the torque, from the rotation shaft G21 to the rotation shaft C3, within a predetermined transmission torque limit. The predetermined torque limit is set to a value which is smaller than a torque caused when the arc part A1 of the sending roller 23A rotates the retard roller 23C.

In the case where the arc part A1 of the sending roller 23A contacts the retard roller 23C, if a sheet of paper lies between the arc part A1 and the retard roller 23C, the retard roller 23C rotates in accordance with rotation of the arc part A1, or the retard roller 23C rotates in accordance with movement of the sheet of paper being carried by the arc part A1. In the case where a plurality of sheets of paper lie between the arc part A and the retard roller 23C, since the frictional force caused between the plurality of sheets of paper is smaller than the torque transmitted through the torque limiter, the retard roller 23C rotates in the clockwise direction and thereby returns one of the sheets of paper contacting the retard roller 23C to the paper supply tray 21 side. The arc part A1 sends out a sheet of paper contacting the arc part A1 to the rotational direction of the arc part A1 (i.e., the carrying roller 26 side). In this way, the sheets of paper are separated one by one and are carried.

When the retard roller 23C is to be rotated in the counterclockwise direction (supplying direction), the torque limiter TL is able to transmit the torque larger than or equal to the predetermined torque limit. Specifically, the torque limiter TL may be configured such that a frictional load is applied for example by a spring with respect to a free rotation direction of a one way clutch, or may be configured as a torque limiter having a structure where different transmission torque values can be set in accordance with the rotation direction of an input shaft.

With this configuration, when the sheet of paper P is carried by the retard roller 23C, the shortage of the carrying force by sliding of the torque limiter TL is not caused. As a result, it becomes possible to carry the sheet of paper P with a sufficiently strong carrying force.

Figure 5:
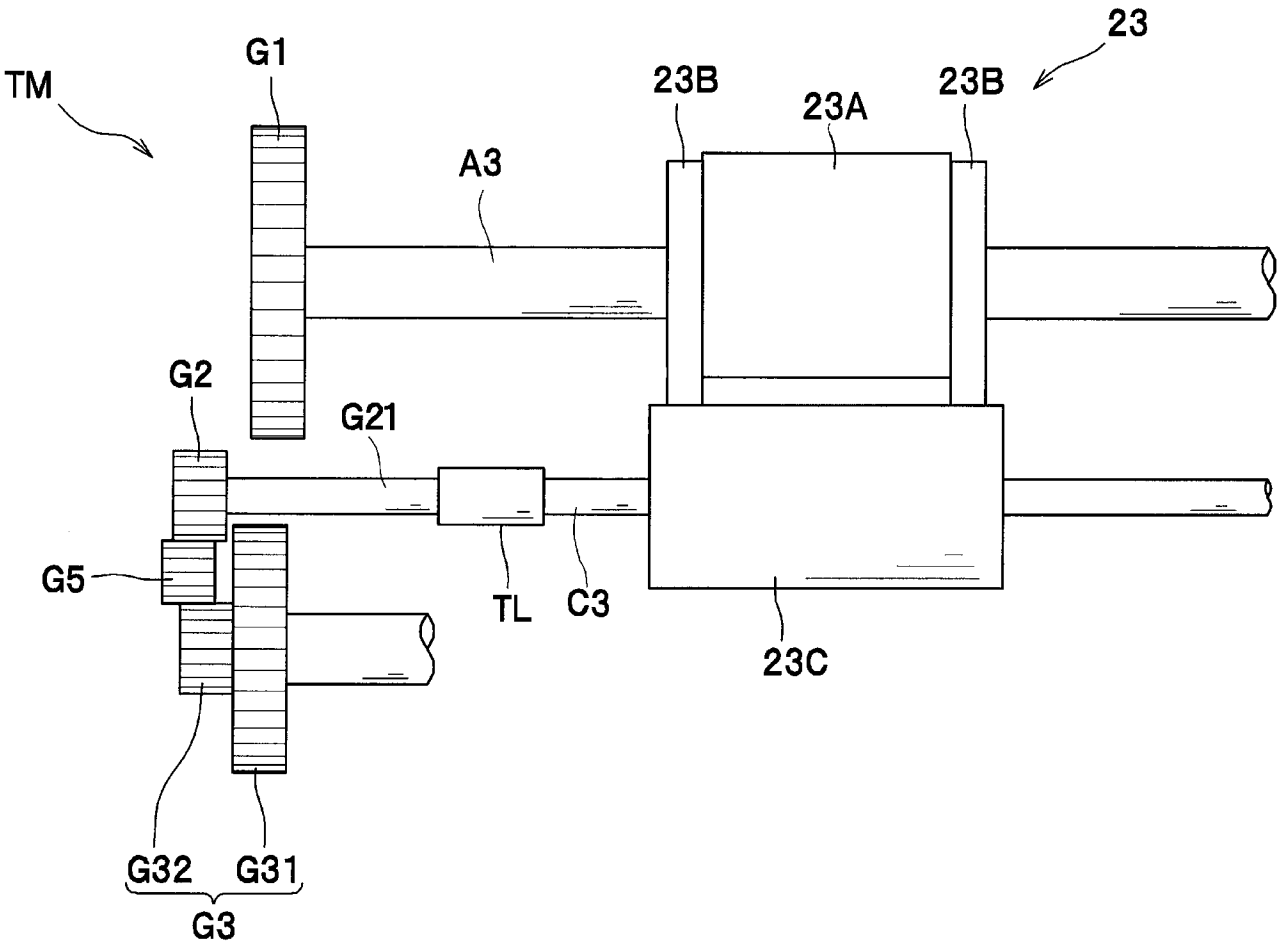
FIG. 5 illustrates the supply and separation mechanism viewed from a paper carrying direction.
Figure 6A:
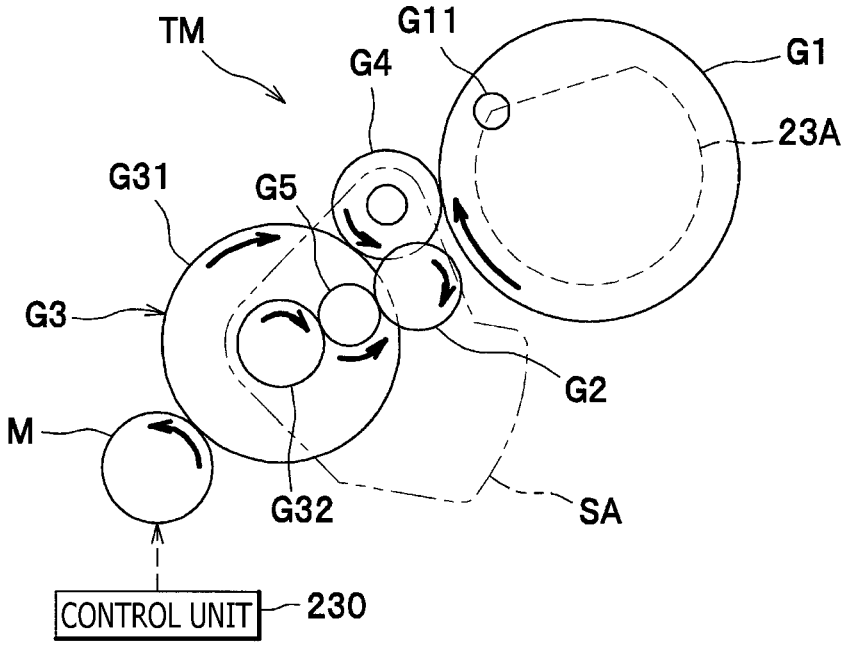
FIG. 6A is a side view illustrating a transmission mechanism for transmitting a driving force to the supply and separation mechanism during the top-face printing.
Figure 6B:
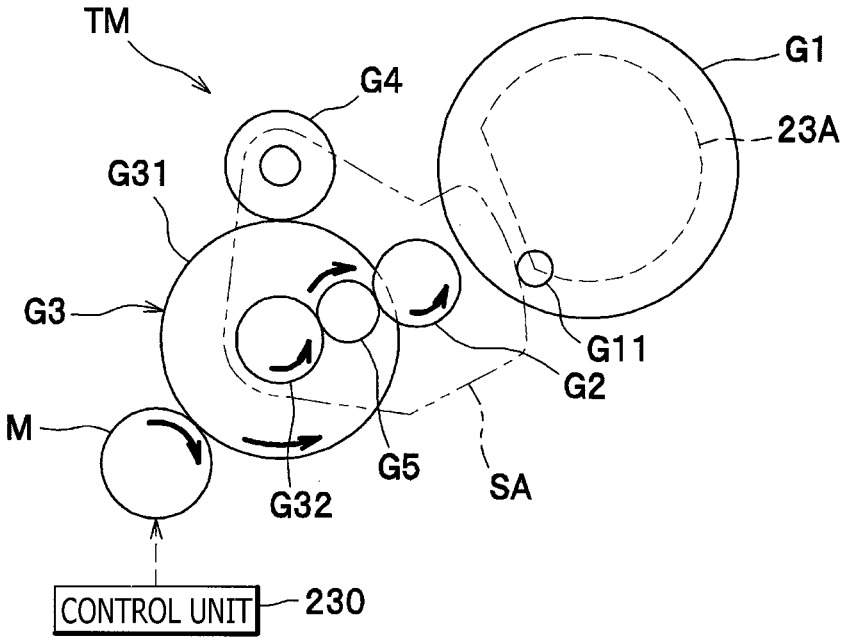
FIG. 6B is a side view illustrating the transmission mechanism during the back-face printing.

To the sending gear G1 and the retard gear G2, the driving force is input by a transmission mechanism TM shown in FIGS. 5 and 6A-6B. The transmission mechanism TM constitutes a part of the control unit 23, and is configured to cause the sending roller 23A to stop after making one rotation. As shown in FIG. 6A, the transmission mechanism TM includes a sun gear G3, a planetary gear G4 and an intermediate gear G5.

The sun gear G3 is a two step gear to which the driving force is transmitted from the motor M. The sun gear G3 is configured such that a large diameter gear G31 engages with the planetary gear G4, and a small diameter gear G32 engages with the intermediate gear G5. In this embodiment, the motor M is separately provided from other motors for driving, for example, the carrying roller 26.

The planetary gear G4 is supported by a swinging arm SA which is able to swing with respect to a rotation center of the sun gear G3. Therefore, the planetary gear G4 is able to move around the large diameter gear G31 of the sun gear G3 while engaging with the large diameter gear G31. The intermediate gear G5 is rotatably provided in the main body 2. The intermediate gear G5 engages with the retard gear G2 and the small diameter gear G32 of the sun gear G3.

In the transmission mechanism TM, when the motor M rotates normally (i.e., in the counterclockwise direction in FIGS. 6A and 6B), the retard gear G2 rotates in the inverse direction of the supplying direction via the sun gear G3 and the intermediate gear G5. In this case, since the sun gear G3 rotates in the clockwise direction, the swinging arm SA swings in the clockwise direction and the planetary gear G4 engages with the sending gear G1, and thereby the sending gear G1 rotates in the supplying direction (i.e., in the clockwise direction). As a result, as shown in FIG. 4A, the sheets of paper P in the paper supply tray 21 are separated one by one and the separated sheet of paper is sent out by the supply and separation mechanism 23.

Figure 4B:
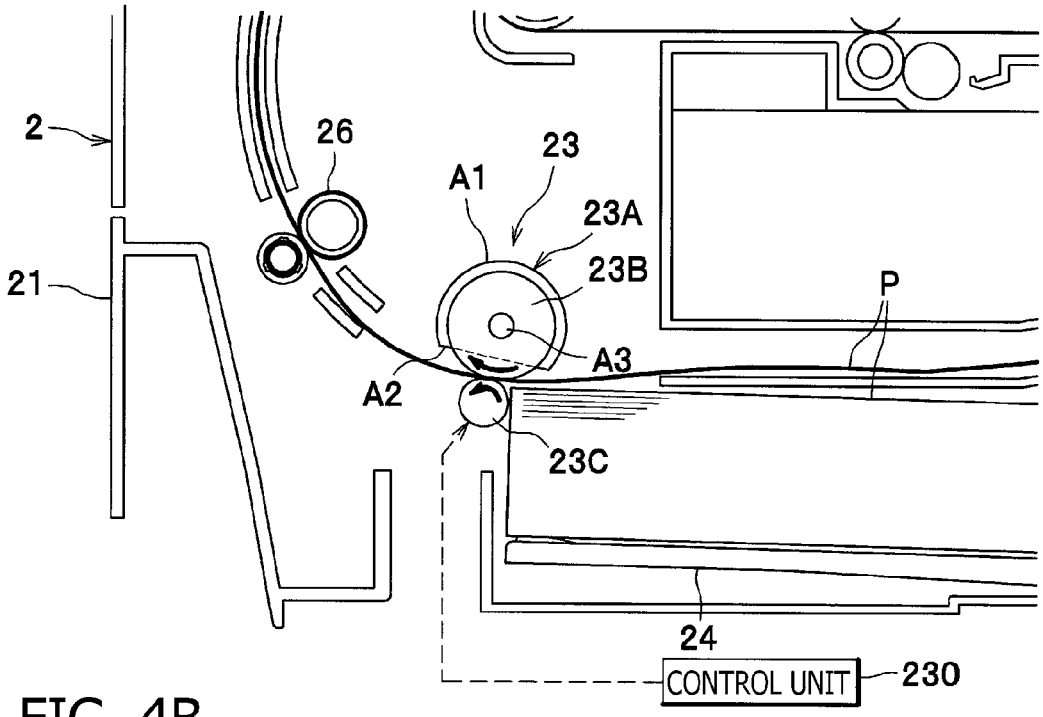
FIG. 4B is a vertical cross section illustrating the supply and separation mechanism during back-face printing.

As shown in FIG. 6B, when the motor M rotates inversely (i.e., in the clockwise direction), the retard gear G2 rotates in the supplying direction (in the counterclockwise direction) via the sun gear G3 and the intermediate gear G5. In this case, since the sun gear G3 rotates in the counterclockwise direction, the swinging arm SA swings in the counterclockwise direction, and thereby the planetary gear G4 departs from the sending gear G1. Therefore, as shown in FIG. 4B, the sending roller 23A does not rotate, and only the retard roller 23C and the independent roller 23B following the retard roller 23C rotate. Consequently, the sheet of paper P is carried by the rollers 23C and 23B.

As shown in FIG. 6B, the swinging arm SA is hooked to a projection G11 formed on a surface of the sending gear G1 in the state where the swinging arm SA is stopped at a predetermined position by a restriction member (not shown). As a result, it becomes possible to keep the sending roller 23A at an initial position (where the recess A4 faces the retard roller 23C) and to prevent the sending roller 23A from being rotated in accordance with the rotation of the independent roller 23B which follows rotation of the retard roller 23C.

The motor M is controlled appropriately by the control unit 230. Specifically, the control unit 230 includes a CPU, a ROM and a RAM. For example, the control unit 230 receives a print command (print data), and controls the paper supply unit 20, the image formation unit 30, the paper ejection unit 90 and the re-carrying mechanism 100.

In particular, in this embodiment, during the back-face printing (i.e., when the sheet of paper P which has passed through a re-carrying path 110 is supplied again to the image formation unit 30), the control unit 230 rotates the retard roller 23C in the inverse direction (supplying direction) of the direction used during the top-face printing.

Specifically, when a print command is received (during the top-face printing), the control unit 230 drives the motor M to rotate normally for a predetermined time so that the sending roller 23A makes one revolution from an initial position and returns and stops at the initial position (as shown in FIG. 6A). As a result, the sending roller 23A makes one revolution in the direction shown in FIG. 4A, and the sheet of paper P in the paper supply tray 21 is sent out to the carrying roller 26. On the other hand, because of the function of the torque limiter TL, when a plurality of sheets of paper lie between the arc part A1 and the retard roller 23C, a sheet of paper of the plurality of sheets of paper contacting the retard roller 23C is returned by the reverse rotation of the retard roller 23C. Then, the recess A2 of the sending roller 23A returns to the initial position facing the retard roller 23C, and stops. Consequently, the sheet of paper P is carried to the image formation unit 30 by the carrying roller 26.

When a print command for both-side printing is received, the control unit 230 controls the motor M to rotate inversely after a predetermined time has elapsed from the time of completion of the top-face printing (and before the leading edge of the sheet of paper P which has moved inversely reaches a nipping position between the independent roller 23B and the retard roller). As a result, as shown in FIG. 6B, the swinging arm SA swings and transmission of the driving force to the sending roller 23A is cut off, and as shown in FIG. 6B the retard roller 23C rotates in the supplying direction in the state where the sending roller 23A stops at the initial position. Therefore, during the back-face printing, the retard roller 23C and the independent roller 23B serve as carrying rollers, and the sheet of paper P which has been subjected to the top-face printing can be carried to the image formation unit 30.

The timing when the motor M is rotated inversely can be set at any time after the sheet of paper P has passed the nipping part between the independent roller 23B and the retard roller 23C. For example, the timing when the motor M is rotated inversely may be set at a time before the top-face printing for the first sheet of paper has finished (i.e., during the printing).

The time period for which the motor M is rotated inversely may be set for a time period which is at least larger than or equal to a time that elapses until the leading edge of the sheet of paper is pinched by the carrying roller 26 from the time when the leading edge of the sheet of paper P reaches the position between the independent roller 23B and the retard roller 23C. The motor M may be rotated inversely for a time period that elapses until the trailing edge of the sheet of paper P completely passes the position between the independent roller 23B and the retard roller 23C from the time when the leading edge of the sheet of paper P reaches the carrying roller 26 so that the independent roller 23B and the retard roller 23C do not cause friction during carrying of the sheet of paper P.

Hereafter, the re-carrying mechanism 100 is explained in detail, as shown in FIG. 1, the re-carrying mechanism 100 includes the ejection rollers 93 and 94, a re-carrying path 110 having a form of a letter "U" to guide the inversely moved sheet of paper P by the ejection rollers 93 and 94 toward the supply and separation mechanism 23, and re-carrying rollers 120 (two pairs of rollers) provided along the re-carrying path 110. The re-carrying path 110 is provided to return the sheet of paper P which has been ejected from the image formation unit 30 to the paper carrying path 28. The re-carrying path 110 merges with the paper carrying path 28 on the upstream side of the nipping part between the independent roller 23B and the retard roller 23C.

Specifically, the re-carrying path 110 includes members (e.g., a plurality of ribs 111 formed on a rear cover 2A of the main body 2) constituting the ejection side carrying path 91, and a carrying guide 112 formed to be substantially horizontal so as to let the sheet of paper 2 to pass between the paper supply tray 21 and the image formation unit 30 (the belt cleaner 10).

The carrying guide 112 is provided to extend from the rear side to the front side, and the downstream side end thereof is elongated to the position close to the nipping part between the independent roller 23B and the retard roller 23C and to the position close to the guide 28A of the paper carrying path. Specifically, the upper surface of the downstream side end of the carrying guide 112 is positioned at the same height as that of the nipping part between the independent roller 23B and the retard roller 23C. It is preferable that, in the state where the sheets of paper P on the pressure plate 24 are at the supplying position (i.e., the lifted position where the sheets of paper P is able to contact the sending roller 23A), the sheets of paper P on the pressure plate 24 depart in the vertical direction from the carrying guide 112 by a distance approximately equal to the difference between the radius of the of the arc part A1 of the sending roller 23A and the radius of the independent roller 23B. The downstream side end of the carrying guide 112 is formed to be partially cut off at a portion where the sending roller 23A and the independent roller 23B are situated (see FIG. 3). With this configuration, it becomes possible to securely carry the sheet of paper P to the nipping part between the independent roller 23B and the retard roller 23C. It should be noted that the downstream side end of the carrying guide 112 may be situated on the rear side of the paper supply and carrying mechanism 23, and, during the back-face printing, the sheet of paper P may be guided from the re-carrying mechanism 110 to the paper carrying path 28 by utilizing the top-face of the sheets of paper P between the carrying guide 112 and the guide 28A.

The re-carrying roller 120 is a pair of rollers carrying the sheet of paper P while pinching the sheet of paper P therebetween. Of the pair of rollers 120, a roller 121 contacting the top face of the sheet of paper P on which an image has been formed is made of resin, and the other roller 122 contacting the back face of the sheet of paper P is made of rubber having a high degree of friction with respect to the sheet of paper P. Since the resin as material of the roller 121 has a property that an image (toner) printed on the top-face of the sheet of paper P is hard to adhere thereto in comparison with the rubber as material of the roller 122, it is possible to prevent the toner from adhering again to the top-face of the sheet of paper P via the roller 121. Consequently, it becomes possible to enhance the quality of image formed on the top face of the sheet of paper P.

The pair of re-carrying rollers 120 located on the most downstream side in the paper carrying direction and the supply and separation mechanism 23 are arranged to have an interval which is smaller than or equal to the minimum permissible size of the sheet of paper P for which the color printer 1 is able to execute the back-face printing. That is, during the back-face printing, the retard roller 23C and the independent roller 23B can be used as carrying rollers by rotating the retard roller 23C in the supplying direction in the state where the recess A2 of the sending roller 23A is positioned to face the retard roller 23C. As a result, even if the distance between the re-carrying roller 120 and the carrying roller 26 is long, it is possible to carry a small-sized sheet of paper P having the length smaller than or equal to the distance between the re-carrying roller 120 and the carrying roller 26.

Regarding a conventional configuration where a supply roller for supplying a sheet of paper in a paper supply tray is separated from the sheet of paper during the back-face printing, the re-carrying roller located on the most downstream side and the carrying roller located on the downstream side of the supply roller need to be located to have an interval which is smaller than the minimum permissible size of the sheet of paper. In this case, it is necessary to provide an additional re-carrying roller in the vicinity of the supply roller. By contrast, according to the embodiment, the supply and separation mechanism 23 serves also as the supply roller, and the carrying roller. Such a configuration makes it possible to eliminate an extra re-carrying roller. Consequently, according to the embodiment, it is possible to downsize the color printer 1, and to decrease the number of components of the color printer 1.

In this embodiment, the independent roller 23B contacting the top face of the sheet of paper P which has been subjected to the top face printing and has passed through the re-carrying path 110 is made of material having a property that the toner is hard to adhere thereto in comparison with the sending roller 23A. Such a configuration makes it possible to prevent the toner from adhering to the independent roller 23B, and thereby it becomes possible to prevent the sheet of paper P from being tainted by the toner adhered to the independent roller 23B.

Of the pair of re-carrying rollers 120, the roller 121 contacting the top face of the sheet of paper P which has been subjected to the top face printing is made of material having a property that the toner is hard to adhere thereto. Such a configuration makes it possible to prevent the toner form adhering to the roller 121. As a result, it becomes possible to prevent the sheet of paper P from being tainted by the toner adhered to the roller 121.

Although the present invention has been described in considerable detail with reference to certain preferred embodiments thereof, other embodiments are possible.

Second Embodiment

Figure 7A:
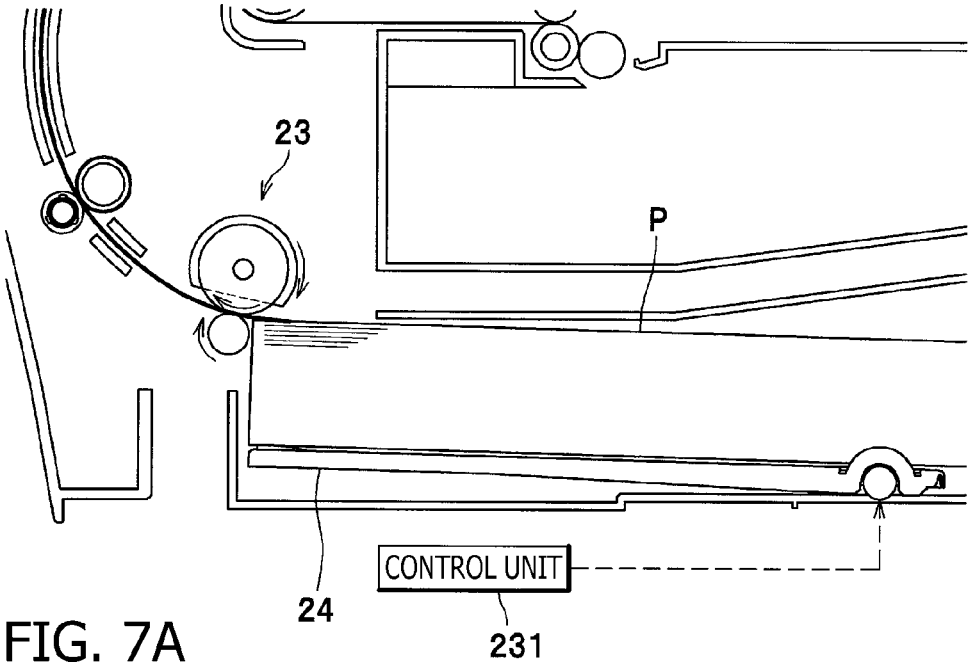
FIG. 7A is a vertical cross section corresponding to FIGS. 4A and 4B, illustrating a configuration according to a second embodiment during the top-face printing.
Figure 7B:
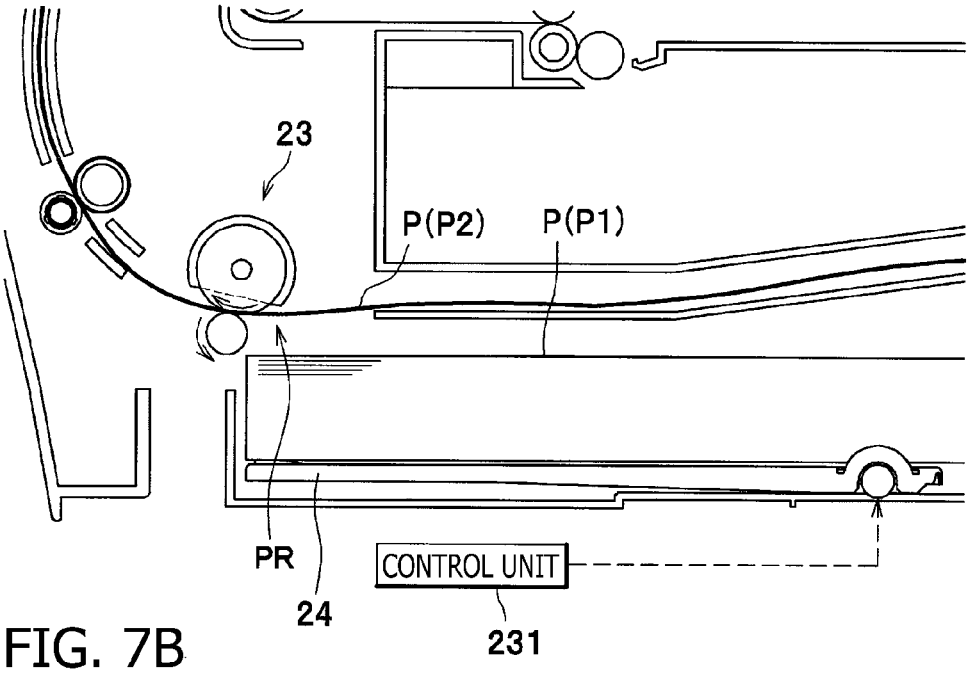
FIG. 7B is a cross section illustrating a situation where the configuration shown in FIG. 7A is in the state of the back-face printing.

Hereafter, a second embodiment is described with reference to FIGS. 7A and 7B. In the following explanation, to elements which are substantially the same as those of the first embodiment, the same reference number are assigned, and explanations thereof will not be repeated. In the following, explanation focuses on the feature of the second embodiment. In this embodiment, the control unit 231 controls the pressure plate 24 to move downward during the back-face printing. Specifically, the control unit 231 controls a driving mechanism having a known configuration for moving the pressure plate 24 in the vertical direction so that the pressure plate 24 is lifted up to the height where the top face of the sheet of paper P on the pressure plate 24 is able to contact the sending roller 23A during the top-face printing (see FIG. 7A), and that the pressure plate 24 is lowered to the position where the top face of the sheet of paper P on the pressure plate 24 has an interval with respect to the sending roller 23A and the independent roller 23B during the back-face printing (see FIG. 7B).

Since the sheet of paper P supported by the pressure plate 24 departs downward from the carrying guide 112, the interval between the top face of the sheet of paper P on the pressure plate 24 and the path PR on the carrying guide 112 along which the sheet of paper P2 is re-carried is increased. Consequently, it is possible to prevent the sheets of paper P1 and P2 from being doubly carried due to the fact that the sheet of paper P2 being re-carried contacts the sheet of paper P on the pressure plate 24 through the partially cut off part of the carrying guide 112.

Third Embodiment

Figure 8:
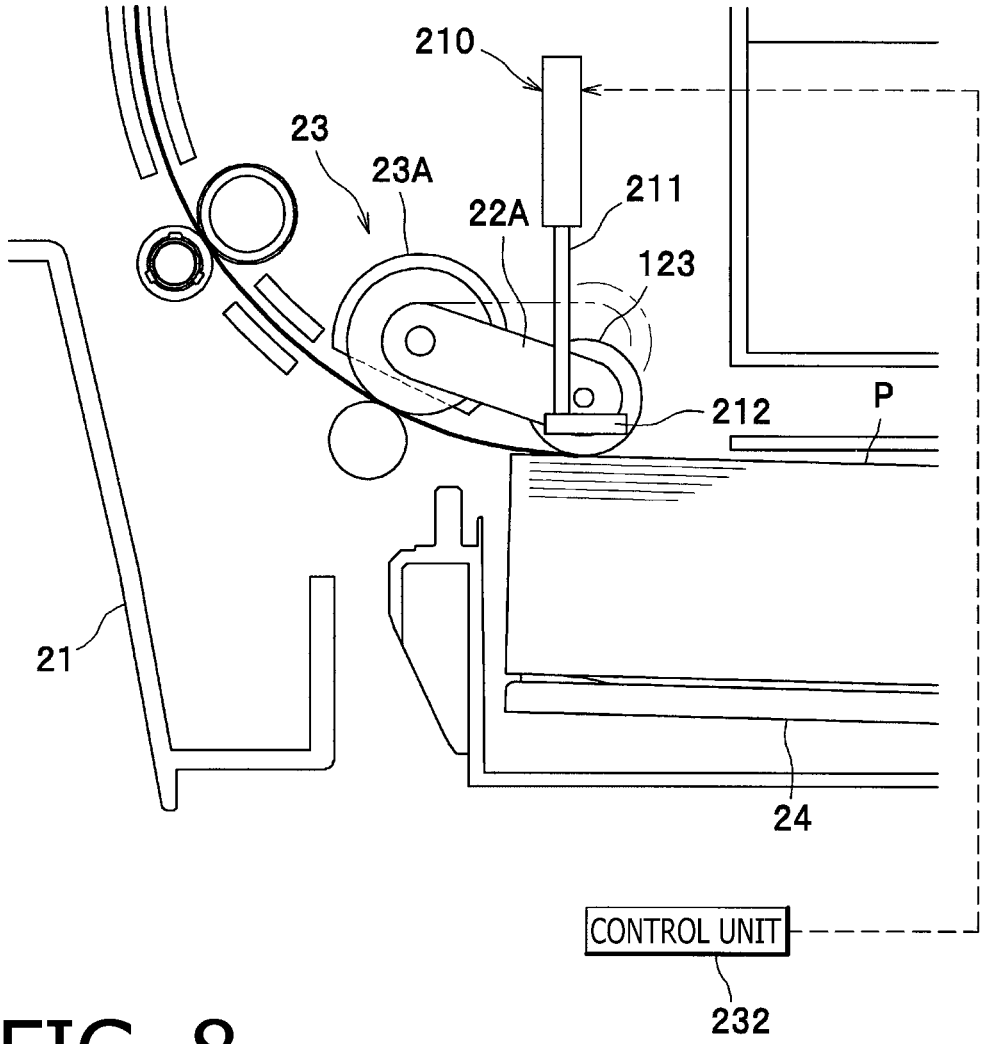
FIG. 8 is a vertical cross section corresponding to FIGS. 4A and 4B, illustrating a configuration according to a third embodiment.

Hereafter, a third embodiment is described with reference to FIG. 8. In the following explanation, to elements which are substantially the same as those of the first embodiment, the same reference number are assigned, and explanations there of will not be repeated. In the following, explanation focuses on the feature of the third embodiment. In this embodiment, a supply roller 123 is provided separately from the paper supplying and separation roller 23.

In this embodiment, a moving mechanism 210 which causes the supply roller 123 to move closer to or away from the sheet of paper P in the paper supply tray 21 is provided. The control unit 232 controls the moving mechanism 210 such that the supply roller 123 contacts the top face of the sheet of paper P in the paper supply tray 121 during the top-face printing, and that the supply roller 123 is moved away from the sheet of paper P during the back-face printing. Specifically, in the configuration, the supply roller 123 is provided on the upstream side of the supply and separation roller 23 in the paper carrying direction (i.e., at the position where the supply roller 123 contacts the sheet of paper P in the paper supply tray 121), and the supply roller 123 is caused to contact the sheet of paper P in the paper supply tray 21 by a bracket 22A which is pressed in the clockwise direction by a spring (not shown) or by weight of the supply roller 123.

The bracket 22A is provided to be able to swing with respect to the rotation axis of the sending roller 23A, and a tip part of the bracket 22A rotatably supports the supply roller 123. The moving mechanism 210 includes an actuator (e.g., a solenoid or a motor) having an advancing shaft 211 which is able to advance of back in the vertical direction. At a tip of the advancing shaft 211, a hook part 212 which can be hooked to the rotation shaft of the supply roller 123 (or a part of the bracket 22A) in the moving direction of the advancing shaft 211.

By backing the advancing shaft 211, the moving mechanism 210 causes the hook part 212 to be hooked to the rotation shaft of the supply roller 123 so that the supply roller 123 is lifted up upward against the pressing force of a spring (not shown).

Thus, the supply and separation mechanism 23 is used merely as a separation roller. As in the case of the above described embodiments, the supply and separation mechanism 23 is used as the carrying roller during the back-face printing.

Fourth Embodiment

Hereafter, a fourth embodiment is described with reference to FIGS. 9A and 9B. In the following explanation, to elements which are substantially the same as those of the first embodiment, the same reference number are assigned, and explanations there of will not be repeated. In the following, explanation focuses on the feature of the fourth embodiment. The fourth embodiment provides an example of a transmission mechanism TM where the sending roller 23A is controlled to make one revolution and is stopped at the initial position.

The mechanism includes an incompletely toothed gear 310 integrally connected with the rotation shaft A3 of the sending roller 23A, a leaf spring 320 which presses a cam 311 of the incompletely toothed gear 310 in the clockwise direction, a restriction plate 330 which restricts the rotation of the incompletely toothed gear 310 by engaging with a step 312 of the incompletely toothed gear 310, a solenoid 340 which causes the restriction plate 330 to swing, and a coil spring 350. During the normal operation, an incompletely toothed part 313 of the incompletely toothed gear 310 faces a transmission gear 360 to which the driving force from a motor is transmitted.

Figures 9A, 9B:
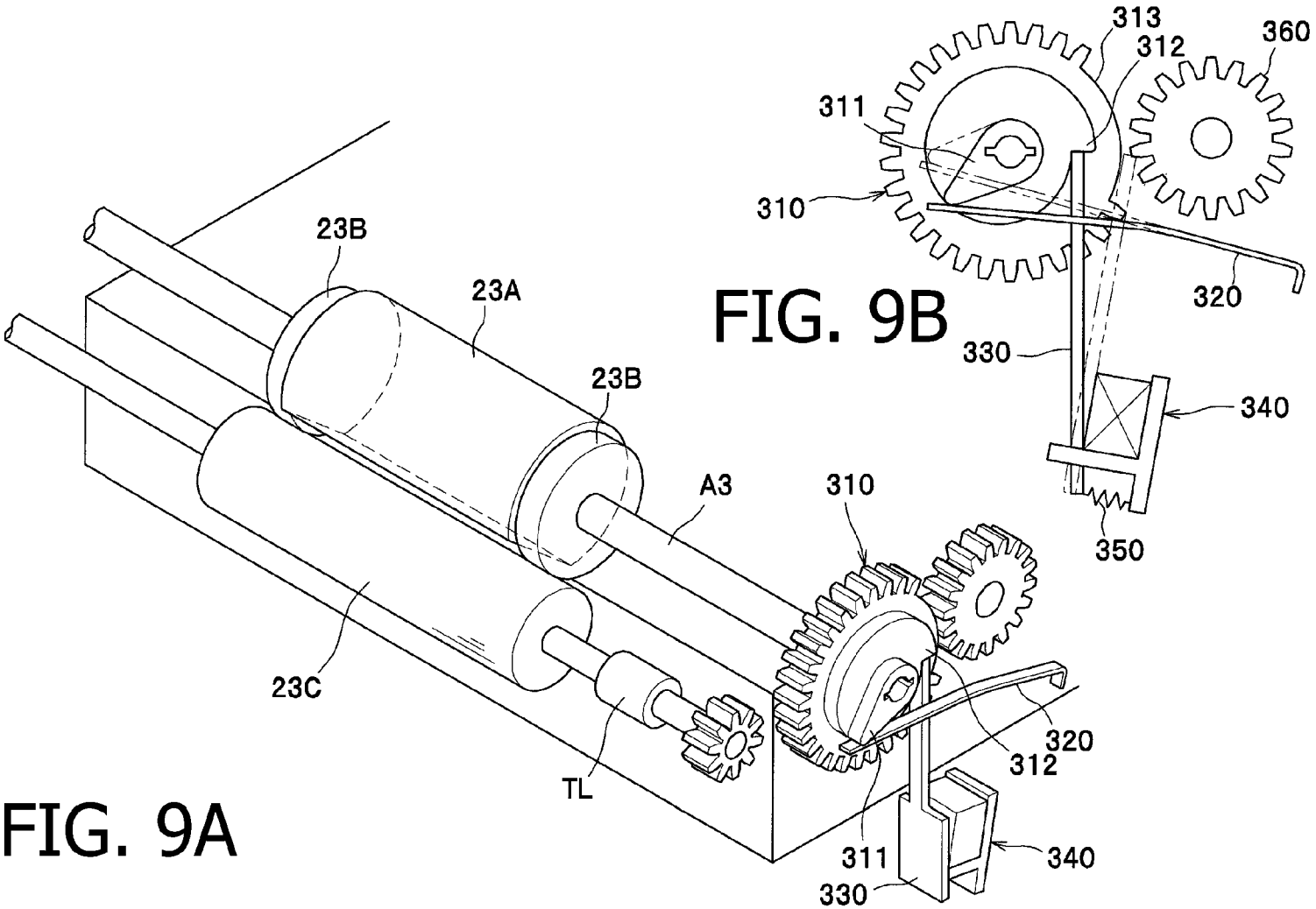
FIG. 9A is a perspective view of a transmission mechanism according to a fourth embodiment.
FIG. 9B is a side view of the transmission mechanism shown in FIG. 9A.

In this configuration, as shown in FIG. 9B, when the restriction plate 330 is detached from the step 312 by the solenoid 340 from the normal state, the cam 311 is pushed by the leaf spring 320, and thereby the incompletely toothed gear 310 rotates by a predetermined angle in the clockwise direction. As a result, the tooth of the incompletely toothed gear 310 engages with the transmission gear 360, and thereby the sending roller 23A rotates by the driving force from the motor.

When the incompletely toothed gear 310 makes one revolution and faces the transmission gear 360 again, the driving force from the motor is cut off and stops. As a result, it is possible to cause the sending roller 23A to make one revolution and to stop at the initial position.

Other Embodiments

In the above described embodiment, during the top-face printing, the retard roller 23C is rotated inversely with respect to the supplying direction. However, the present invention is not limited to such a configuration. The retard roller may be stopped when the sheet of paper is supplied.

In the above described embodiment, the sheet of paper P is used as an example of a sheet-like medium. However, the sheet of paper P includes thick paper, a post card and thin paper. A resin sheet, such as an OHP sheet, may be employed as a sheet-like medium.

In the above described embodiment, the disclosed feature is applied to a color printer. However, the present invention is not limited to such a configuration. For example, the disclosed feature may be applied to various types of image forming devices such as a copying device and a multifunction device. Alternatively, the disclosed feature may be applied to a document reading device configured to read both sides of a document, both sides of which have images. In this case, an image reading unit corresponds to the image formation unit.

In the above described embodiment, each of the independent roller 23B and the roller 121 of the re-carrying rollers 120 is made of resin. However, the present invention is not limited to such a configuration. For example, material (e.g., metal) having a property that toner is hard to adhere thereto in comparison with rubber may be used.

In the above described embodiment, by providing the transmission mechanism TM, a single motor M can be used to transmit the driving force to the sending roller 23A and the retard roller 23C. However, the present invention is not limited to such a configuration. For example, a motor for the sending roller and a motor for the retard roller may be separately provided. Furthermore, a driving force from the motor for driving other rollers such as a carrying roller may be transmitted to the sending roller and the retard roller.

What is claimed is:

1. An image processing device, comprising:

a supplying path along which a sheet-like medium is carried from a sheet accommodation unit to an image processing unit;

a re-carrying path along which the sheet-like medium ejected from the image processing unit is returned to the supplying path; and a supply and separation mechanism which is provided on the supplying path and is configured to carry and separate the sheet-like medium one by one as a supplying operation, the supply and separation mechanism comprising:

a sending roller which rotates in a supplying direction to supply the sheet-like medium in the supplying direction during the supplying operation, the sending roller including an arc part which sends out the sheet-like medium in the supplying direction by contacting the sheet-like medium and rotating, and a recess which is formed inside of a trace of an outer circumferential surface of the arc part defined when the arc part rotates;

an independent roller provided coaxially with the sending roller and having a radius smaller than or equal to a radius of the arc part and larger than a minimum radius of the recess, the independent roller being able to rotate independently of the sending roller; and a retard roller which is provided to contact the independent roller and the arc part of the sending roller during the supplying operation, and is configured such that, by stopping or rotating in an inverse direction of the supplying direction during the supplying operation, the retard roller causes a frictional resistance with respect to the sheet-like medium being sent out by the arc part of the sending roller so as to separate the sheet-like medium one by one, wherein the re-carrying path merges with the supplying path through a nipping part between the independent roller and the retard roller, the image processing device further comprising:

a control unit configured to receive a command for both-side printing, wherein the control unit is configured to control the retard roller to rotate in the supplying direction, as a re-supplying operation, when the control unit has received the command for both-side printing and re-supplying for supplying again the sheet-like medium which has passed the re-carrying path toward the image processing unit is executed, and wherein the retard roller is configured such that only the retard roller, among the retard roller and the sending roller, rotates to supply the sheet-like medium in the supplying direction during the re-supplying operation.

2. The image processing device according to claim 1, wherein the sending roller and the sheet accommodation unit are arranged such that, by rotation of the sending roller, the arc part contacts the sheet-like medium in the sheet accommodation unit.

3. The image processing device according to claim 2, further comprising a pressure plate which is provided in the sheet accommodation unit and is movable in a vertical direction to lift up an edge portion of the sheet-like medium, wherein the control unit controls the pressure plate to move downward for the re-supplying.

4. The image processing device according to claim 1, wherein the control unit is configured such that, when the sheet-like medium which has passed through the re-carrying path is supplied again to the image processing unit, the control unit stops the sending roller at a position where the recess faces the retard roller.

5. The image processing device according to claim 1, further comprising:

a supply roller which is arranged on an upstream side in a sheet-like medium carrying direction with respect to the supply and separation mechanism and is configured to contact the sheet-like medium in the sheet accommodation unit to supply the sheet-like medium to a downstream side; and a moving mechanism configured to move the supply roller closer to or away from the sheet-like medium in the sheet accommodation unit, wherein, when the re-supplying is executed, the control unit controls the moving mechanism such that the supply roller is in a state of being separated from the sheet-like medium in the sheet accommodation unit.

6. The image processing device according to claim 1, wherein, when the sheet-like medium is supplied from the sheet accommodation unit to the image processing unit, the control unit drives the retard roller in an inverse direction of the supplying direction.

7. The image processing device according to claim 1, wherein at least a part of the re-carrying path is formed by a guide extending toward the nipping part between the independent roller and the retard roller.

8. The image processing device according to claim 1, wherein:

the image processing unit includes an image formation unit configured to form an image formed of a developer on the sheet-like medium; and the independent roller which contacts a printed top-face of the sheet-like medium is made of material having a property that the developer hard to adhere to the material in comparison with the sending roller.

9. The image processing device according to claim 1, wherein:

the image processing unit includes an image formation unit configured to form an image formed of a developer on the sheet-like medium;

a pair of re-carrying rollers that carry the sheet-like medium having a top-face on which an image has been printed are provided along the re-carrying path;

one of the pair of re-carrying rollers contacting the printed top-face of the sheet-like medium is made of material having a property the a developer hard to adhere to the material in comparison with the other of the pair of re-carrying rollers contacting a back-face of the sheet-like medium.

10. The image processing device according to claim 6, wherein:

a driving force is applied from a motor to the retard roller via a torque limiter; and the torque limiter is configured such that:

when the retard roller is rotated in an inverse direction of the supplying direction, a torque is transmitted within a predetermined torque limit; and when the retard roller is rotated in the supplying direction, a torque larger than or equal to the predetermined torque limit can be transmitted.

11. An image processing device, comprising:

a supplying path along which a sheet-like medium is carried from a sheet accommodation unit to an image processing unit;

a re-carrying path along which the sheet-like medium ejected from the image processing unit is returned to the supplying path; and a supply and separation mechanism which is provided on the supplying path and is configured to carry and separate the sheet-like medium one by one as a supplying operation, the supply and separation mechanism comprising:

a sending roller which rotates in a supplying direction to supply the sheet-like medium in the supplying direction during the supplying operation, the sending roller including an arc part which sends out the sheet-like medium in the supplying direction by contacting the sheet-like medium and rotating, and a recess which is formed inside of a trace of an outer circumferential surface of the arc part defined when the arc part rotates;

an independent roller provided coaxially with the sending roller and having a radius smaller than or equal to a radius of the arc part and larger than a minimum radius of the recess, the independent roller being able to rotate independently of the sending roller; and a retard roller which is provided to contact the independent roller and the arc part of the sending roller during the supplying operation, and is configured such that, by stopping or rotating in an inverse direction of the supplying direction during the supplying operation, the retard roller causes a frictional resistance with respect to the sheet-like medium being sent out by the arc part of the sending roller so as to separate the sheet-like medium one by one, wherein the re-carrying path merges with the supplying path through a nipping part between the independent roller and the retard roller, the image processing device further comprising:

a control unit configured to control the retard roller to rotate in the inverse direction of the supplying direction after a portion of the sheet-like medium has passed the nipping part when the sheet-like medium is first carried along the supplying path during the supplying operation, wherein the control unit is configured to control the retard roller to rotate in the supplying direction, as a re-supplying operation, when the sheet-like medium completely passes the nipping part and the sheet-like medium is first carried along the supplying path, and wherein the retard roller is configured such that only the retard roller, among the retard roller and the sending roller, rotates to supply the sheet-like medium in the supplying direction during the re-supplying operation.

* * * * *